US006733431B2

(12) United States Patent
Dufour

(10) Patent No.: US 6,733,431 B2
(45) Date of Patent: May 11, 2004

(54) DEVICE AND METHOD FOR FOLDING NEWSPAPERS WITH FLEXIBLE INSERTING POSITION

(75) Inventor: Charles Henry Dufour, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 186 days.

(21) Appl. No.: 09/956,161

(22) Filed: Sep. 19, 2001

(65) Prior Publication Data

US 2003/0054932 A1 Mar. 20, 2003

(51) Int. Cl.[7] ..... B31F 1/10
(52) U.S. Cl. ..... 493/428; 493/424; 493/476
(58) Field of Search ..... 493/428, 454, 493/424, 422, 471, 476

(56) References Cited

U.S. PATENT DOCUMENTS 3,162,434 A * 12/1964 Strasse ..... 270/52.24
3,561,751 A 2/1971 Dutro
4,036,487 A * 7/1977 Heimlicher et al.
4,957,280 A * 9/1990 Motooka
4,997,205 A 3/1991 Hänsch
5,049,120 A * 9/1991 Priim ..... 493/428
5,065,992 A * 11/1991 Crowley ..... 270/39.05
5,494,270 A * 2/1996 Laubscher
5,527,256 A * 6/1996 Vauchelle et al. ..... 493/428
5,921,906 A * 7/1999 Nagano ..... 493/428
6,358,192 B1 * 3/2002 Michalik ..... 493/424

* cited by examiner

*Primary Examiner*—Rinaldi I. Rada
*Assistant Examiner*—Sameh Tawfir
(74) *Attorney, Agent, or Firm*—Laurence A. Greenberg; Werner H. Stemer; Ralph E. Locher

(57) ABSTRACT

Multi-section print material, such as a newspaper, is folded so as to enable inserts to placed at any location or at multiple locations within the half fold. Several sections are stacked onto one another with one of the signatures offset in the transport direction by a given amount. When the stack is subsequently half-folded, the protruding signature forms a lap which enables an insertion device to automatically insert at the lap position. The system may be operated in straight operation or collect operation. In one embodiment, the sections are transported in two web paths where they are cut into signatures. One of the web paths is delayed so that its signature arrives at the half fold gripper or pin cylinder slightly later than the signature from the other web path. The subsequently formed half fold has the trailing edge of the later-arriving signature protruding by a given lap amount that enables the downline inserter to insert at that position.

7 Claims, 3 Drawing Sheets

DEVICE AND METHOD FOR FOLDING NEWSPAPERS WITH FLEXIBLE INSERTING POSITION

BACKGROUND OF THE INVENTION

FIELD OF THE INVENTION

The invention lies in the fields of newspaper folding and insertion technology. More specifically, the invention pertains to a device and a method for folding newspapers and preparing the half-folded newspaper for the insertion of inserts.

Newspapers are generally printed in rotary printing machines in which a continuous web of paper is fed from a roll and through a plurality of printing units. After the printing is finished in the last printing unit, the web continues on to a folder, which is considered the last module along the press line. In the folder, the web is cut and folded to form signatures. The signatures are arranged in accordance with their page numbers and they are stacked and delivered for post press processing. Such processing includes the insertion of auxiliary materials, such as special journals, advertising brochures, and flyers. The inserts can generally only be placed at the center of the paper, because the half fold can only open in the center.

U.S. Pat. No. 3,561,751 to Dutro describes a mechanism with which the half-folded signatures can be unfolded so that the signatures may be placed into the central fold. In order to allow a punch or a suction wheel to partially open the fold for insertion, a stack of signatures is folded not along the center line, but instead along an off-centered fold line. As a result, one half of the stack is slightly longer and its edge portion thus protrudes from the free end of the folded stack. The protruding portion can then be handled more easily, so that the half-folded stack can be opened for receiving the insert.

U.S. Pat. No. 4,997,205 to Hansch describes a folder in which one of the individual ribbons that are cut from a broadsheet web in a slitter prior to folding is cut with a greater width than the other ribbons. After the ribbons are cut, the signature cut from the wider ribbon is placed as the innermost signature. When the stack of signatures is folded, the innermost signature protrudes past the other signatures. The protruding portion can then be utilized to open the half-folded stack for placing an insert. The protruding material is then cut from the stack after the insert has been placed. The foregoing solutions do not provide for a flexible placement of the insert.

SUMMARY OF THE INVENTION

It is accordingly an object of the invention to provide a newspaper folder and a folding method, which overcomes the above-mentioned disadvantages of the heretofore-known devices and methods of this general type and which allows for completely flexible placement of inserts in newspapers.

With the foregoing and other objects in view there is provided, in accordance with the invention, a method of folding multi-section print material, which comprises:

- transporting a plurality of sections of print material in a folder of a printing machine;
- stacking the sections to form a signature stack having at least one of the signatures offset in the transport direction by a given amount; and
- subsequently folding the stack of signatures to form a half fold with the at least one offset signature protruding from the half fold by the given amount.

In accordance with a preferred embodiment of the invention, the method comprises:

- simultaneously transporting the plurality of sections of print material along a first web path and a second web path;
- cutting the sections of print material in the first and second web paths into respective signatures;
- simultaneously delivering the signatures from the first web path and the second web path to a folding device, with the signatures from the first web path delayed by the given amount so as to form a stack of signatures having the signatures from the first web path offset by the given amount; and
- folding the stack of signatures in the folding device to form the half fold having a trailing edge of the signatures from the first web path projecting from the stack by the given amount.

Typical inserters require a lap amount of approximately 10 to 25 mm.

In accordance with an additional feature of the invention, the print material is transported in a plurality of ribbons, each of the plurality of ribbons of the print material is subjected to a former fold, and the former-folded ribbons are selectively diverted to the first web path or to the second web path.

In accordance with another feature of the invention, the folder is operated in collect mode, i.e., the sections are accumulated and stacked on the first cylinder (pin cylinder or gripper cylinder,) of the folder before the half fold is formed.

With the above and other objects in view there is also provided, in accordance with the invention, a device for folding a newspaper with a plurality of sections, comprising:

- a transport device for transporting a plurality of newspaper sections printed on a continuous web;
- a cutting device receiving the newspaper sections and cutting the continuous web into signatures;
- a folding device receiving the signatures and folding a stack of the signatures in a half fold with at least one of the sections protruding from the stack by a given amount; and
- a half fold delivery receiving the half-folded stack from the folding device and transporting the half-folded stack for further processing.

In accordance with again an added feature of the invention, the transport device includes a plurality of rollers configured to selectively deflect each of the plurality of sections from a plurality of formers to a respective web path, and wherein one web path is configured to delay an arrival of the section transported and cut therein a the folding device by the given amount.

In accordance with again an additional feature of the invention, an idler roller is disposed to selectively delay the arrival of the section transported thereby at the folding device.

In accordance with a concomitant feature of the invention, the cutting device is a two part cutter consecutively cutting two sections from the continuous web, and the cutter is adjusted to cut the sections to mutually different lengths.

In other words, multi-section print material, such as a newspaper, is folded so as to enable inserts to be placed at any location or at multiple locations within the half fold. Several sections are stacked onto one another with one of the signatures offset in the transport direction by a given amount. When the stack is subsequently half-folded, the protruding signature forms a lap which enables an insertion device to automatically insert at the lap position. The system may be operated in straight operation or collect operation. In one embodiment, the sections are transported in two web paths where they are cut into signatures. One of the web paths is delayed so that its signature arrives at the half fold gripper or pin cylinder slightly later than the signature from the other web path. The subsequently formed half fold has the trailing edge of the later-arriving signature protruding by a given lap amount that enables the downline inserter to insert at that position.

With this invention, it is thus possible for inserts to be placed at any location within a section of a half-folded newspaper. For example, the insert can be placed beside a tabloid if the tabloid formed the center section of a broadsheet paper. In general, inserts can be placed between any sections of a newspaper and the invention also allows for inserts at multiple locations.

Other features which are considered as characteristic for the invention are set forth in the appended claims.

Although the invention is illustrated and described herein as embodied in a newspaper folding device and method, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
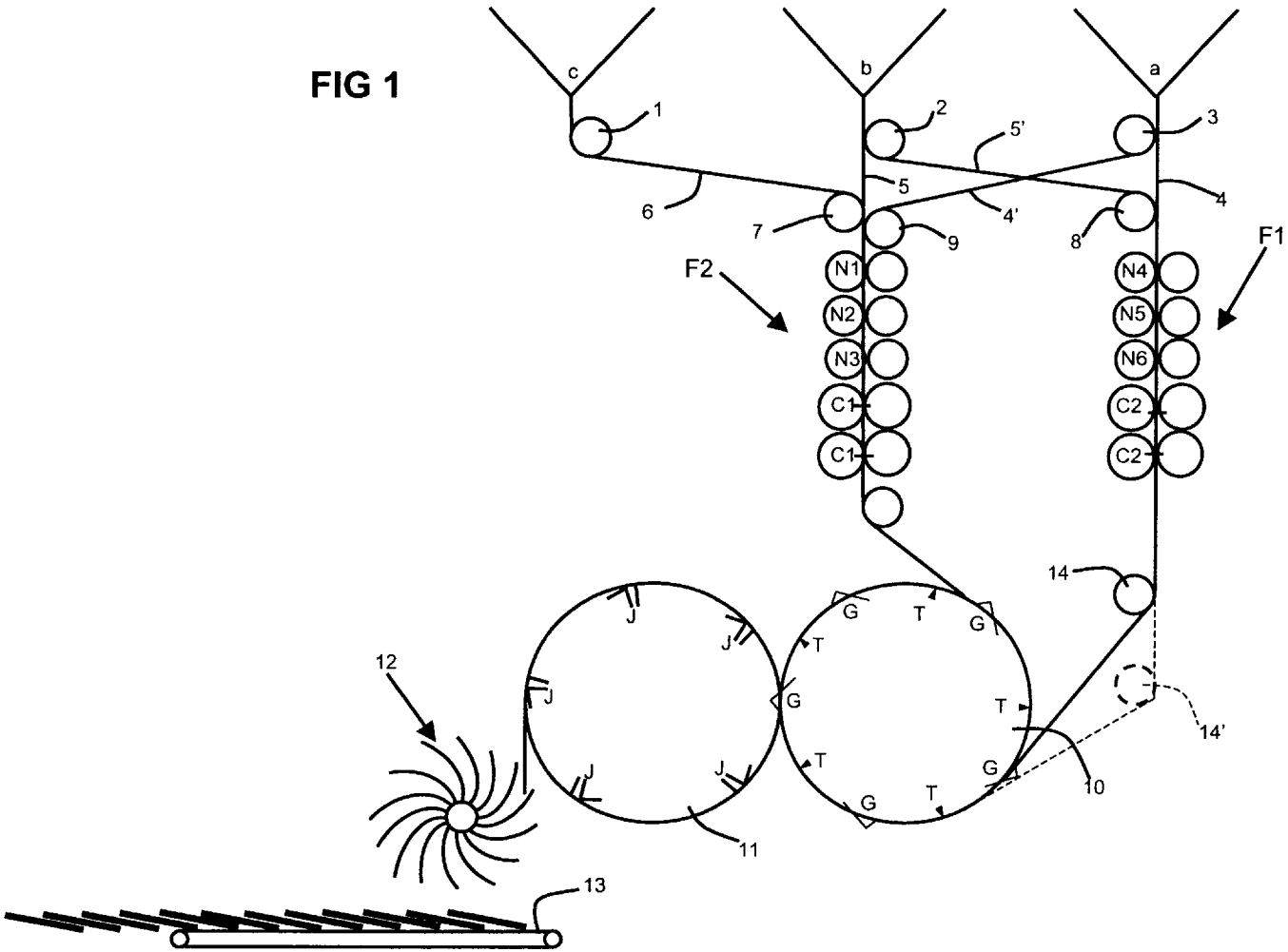
FIG. 1 is a diagrammatic illustration of a pinless folder system running in straight mode.

Referring now to the figures of the drawing in detail and first, particularly, to FIG. 1 thereof, there are seen three parallel formers a, b, and c which receive respective ribbons of printed paper from a non-illustrated slitter. After the ribbons exit from the nose rollers of the formers a, b, and c, they travel past first diverter rollers 1, 2, and 3, respectively. A first ribbon 4, after exiting from the former a, travels either into a first folder path F1 (below the former a) or into a second folder path F2 (centrally below the former b). If the first ribbon 4 is to be deflected, it is diverted by the first diverter roller 3 and then deflected about a second diverter roller 9, where it enters the second folder path F2. The deflected first ribbon is identified as 4'. A second ribbon 5 may either travel into the second folder path F2 or it may be diverted into the first folder path F1 below the former a. In the latter case, the second ribbon 5 is deflected about the first diverter roller 2 and about a second diverter roller 8 into the second folder path F2. The deflected second ribbon is identified as 5'. A third ribbon 6, after exiting from the former c, is diverted via a second diverter roller 7 into the second folder path F2 centrally below the former b.

It is thus seen that all three sections a, b, c can be processed into the second folder path F2. Sections a and b can be selectively processed into the first folder path F1 or into the section folder path F2. Section c can only be processed in the second folder path F2. It will be understood that, if section a is diverted into the second folder path F2, section b is "forced" into the second folder path F2 as well. Similarly, if section b is diverted to the first folder path F1, section a is "forced" into the first folder path as well.

In the first folder path F1, the ribbons traverse a plurality of nips N4, N5, N6 before they are transversely cut at cutting cylinders C2. Similarly, the ribbons in the second folder path traverse a plurality of nips N1, N2, N3 before they are transversely cut at cutting cylinders C1. From there, the cut signatures are taken over by a gripper cylinder 10 which, in the illustrated embodiment, is provided with five grippers G (i.e., it is a so-called five-part gripper cylinder). From the gripper cylinder 10 the signatures are transferred to a jaw cylinder 11. In the course of the transfer from the gripper cylinder 10 to the jaw cylinder 11, the signatures are provided with a parallel fold, i.e., the center fold of the newspaper.

The parallel fold is effected as follows: The leading edge of the signature is retained by the respective gripper G as it passes by the nip between the cylinders 10 and 11. When the center of the signature enters the nip, a tucking blade T pushes a crease of the signature into a jaw J of the jaw cylinder 11. At that point, the leading edge of the signature is released by the gripper G and the folded signature is slaved along by the jaw cylinder 11, before it is transferred into a fan 12. From the fan 12, the half folded newspaper is transferred to a flat half fold delivery, here in the form of a conveyor belt 13.

In the following, assume that the newspaper contains three sections, namely section a (arriving through the former a), section b (former b), and section c (former c). According to the invention it is now possible to direct the folder in any configuration so that it will be possible to insert at any location between the various sections.

Figure 2:
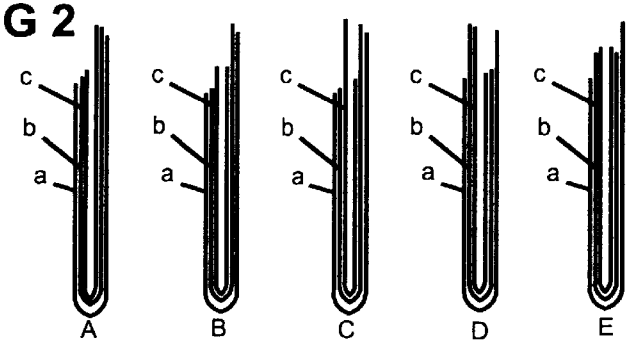
FIG. 2 is a schematic side view of a three-section newspaper with five different half-fold configurations each folded in the system illustrated in FIG. 1 or 3.

Reference is had to FIG. 2, which illustrates five different configurations of the three sections a, b, c. In each case, section a is the outermost section, section c is the innermost section, and section b is placed in between. In the fold configuration A, an insert can be placed in the center of the paper, inside section c. In the fold configuration B, inserts can be placed between sections b and c, that is, in front of section c and/or in back of section c. In the fold configuration C, the insert can be placed in front of section c. In the fold configuration D, the insert will be placed in front of section b. Finally, in the fold configuration E, the insert can be placed between sections a and b, that is, in front of section b and/of in back of section b.

The various fold configurations are attained by selectively diverting the three sections of the newspaper into the first and second folder paths and by setting a phase of the cutting cylinders C1 and C2. Variable phase adjustments can be effected relatively easily where the cutting cylinders are separately motorized, i.e., when the cutting cylinders are driven via separate motors. However, it is also possible to change the phase by adjusting a differential gearing of the drive transmissions of the cutting cylinders. In an alternative embodiment, it is also possible to selectively lengthen one of the folder paths by suitably moving one or more idler rollers 14. As illustrated in FIG. 1, the idler roller 14 can function as a compensator roller 14' which lengthens the first folder path to ensure that the signature(s) arriving at the gripper cylinder 10 are delayed by the amount of overlap necessary to cause any of the fold configurations A–E.

With reference to FIG. 2 and the following table, the selective diversion and the phase of the cutting cylinders (the idler roller adjustment is equivalent to the cutting cylinder phase adjustment) leads to the attainment of the various configurations as follows:

| Fold | Path F2 N1, N2, N3 | Cut C1 | Path F1 N4, N5, N6 | Cut C2 | Insert Position |
|---|---|---|---|---|---|
| A | a + b + c | Regular | idle | Idle | Center |
| B | c | Partial advance | a + b | Regular | In front of c and/or behind c |
| C | c | Full advance | a + b | Regular | In front of c |
| D | b + c | Full advance | a | Regular | In front of b |
| E | b + c | Partial advance | a | Regular | In front of b and/or behind b |

It can be seen that the novel device and method allow for the selective preparation of the half-folded newspaper with an insertion position at any location. The offset—referred to as the lap—should be approximately 10 mm to 25 mm. Also, multiple insertion positions (multiple laps) are possible, as illustrated in the folds B and E.

Figure 3:
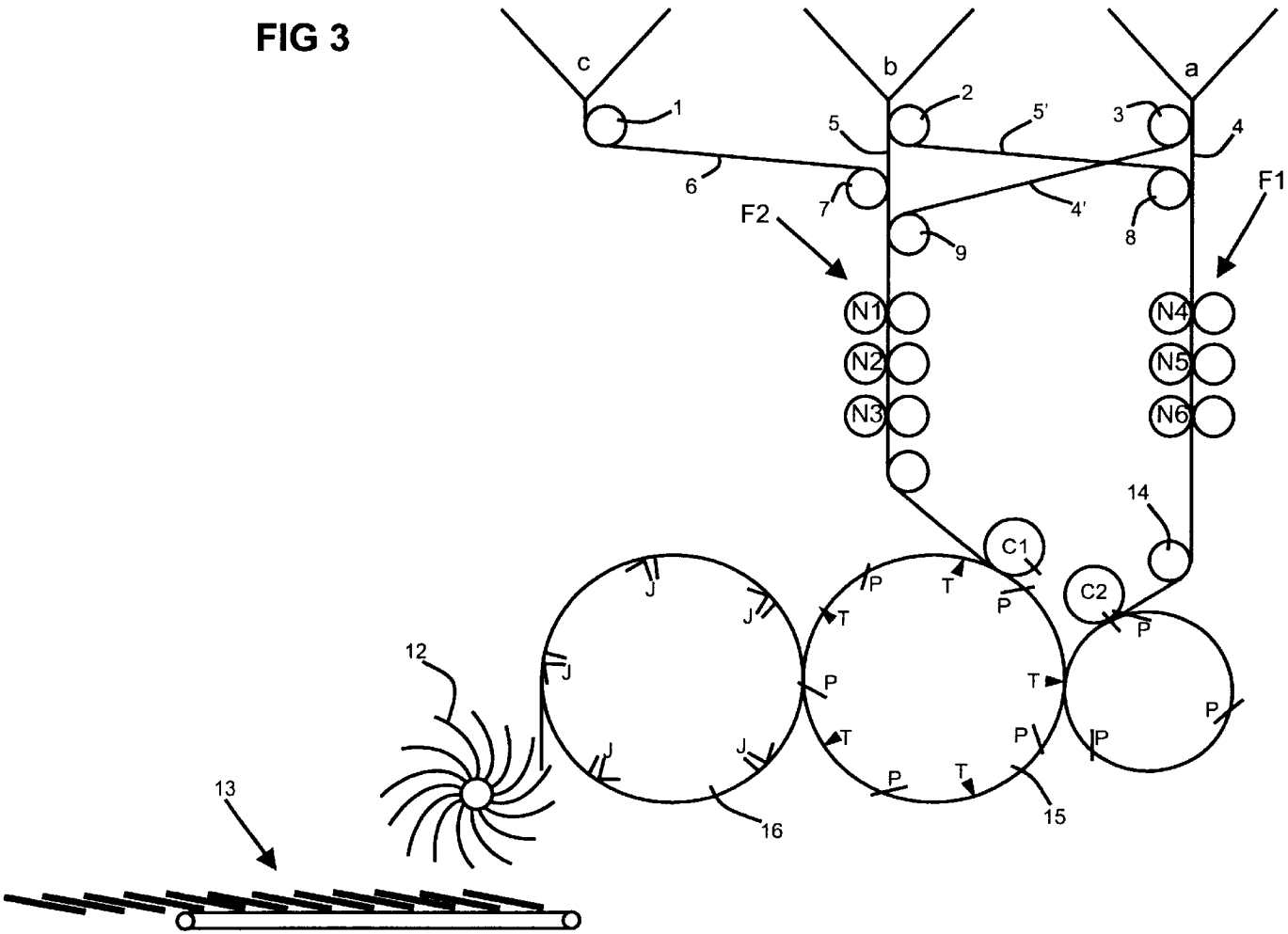
FIG. 3 is a diagrammatic illustration of a pinned folder operating in straight mode.

With reference to FIG. 3, there is illustrated a folder which is embodied as a pinned folder. The same structure with regard to the formers and the folder paths F1 and F2 is illustrated upstream of the cutting cylinders. Here, the cutting cylinder C1 (a one part cutting cylinder) cuts in cooperation with a pin cylinder 15 which, after the ribbon is cut into the signature, holds the signature on pins P. The transfer of the signature to the jaw cylinder 16 is once more effected by the tucker blades T. The signatures are then delivered to the fan 12 and subsequently to the pinned half fold delivery 13.

The above table and the fold configurations according to FIG. 2 apply to the embodiment of FIG. 3 equally.

The foregoing description pertains to so-called straight operation. In this case, each signature runs about the gripper cylinder 10 or the pin cylinder 15 only along its lower hemisphere before it runs onto the jaw cylinder 11 or 16, respectively. The system is equally applicable to collect operation, however.

Figure 4:
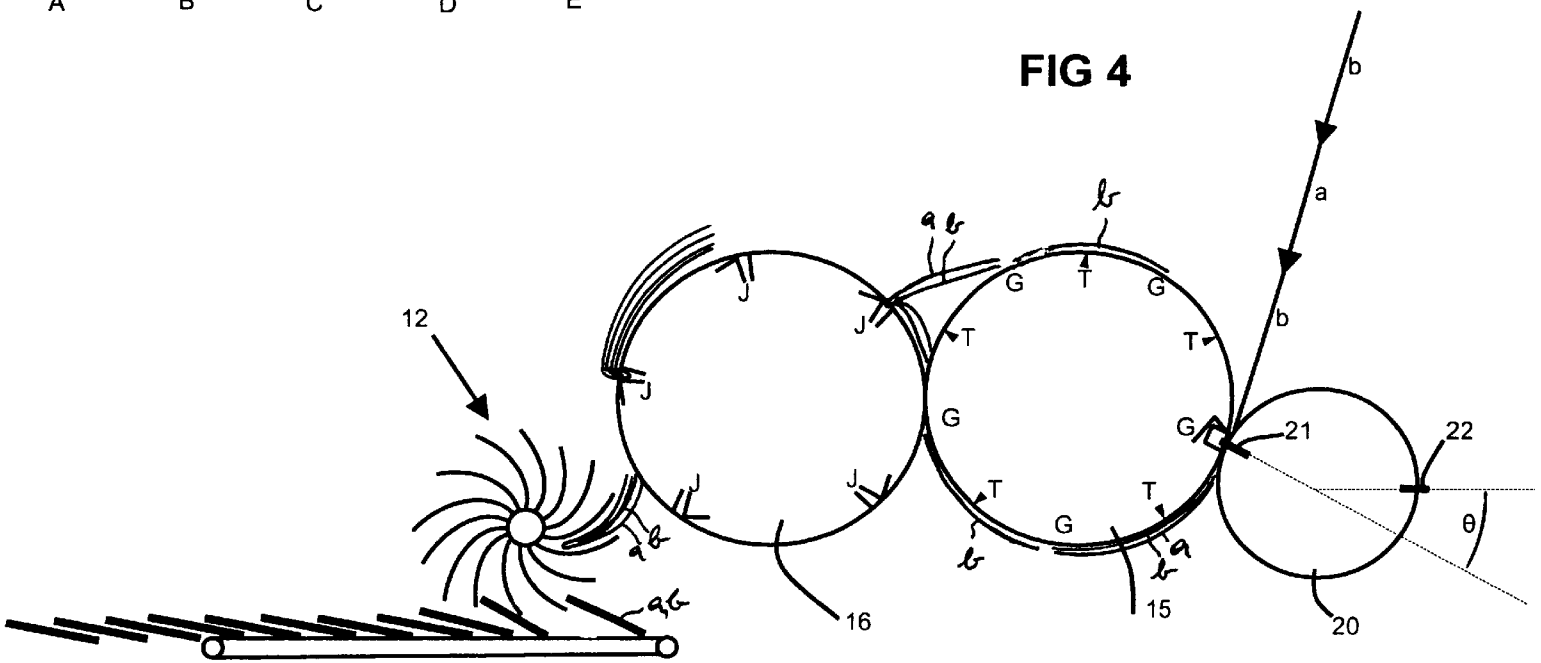
FIG. 4 is a diagrammatic folder of a pinned folder system operating in collect mode.

With reference to FIG. 4, collect operation of the folder applies when the printing units print two or more sections one after the other. For example, if the print circumference of the plate cylinder is twice the cutoff length, then it is possible to either print two identical sections per each rotation and then collect the signatures in straight operation, or to print two separate sections on one printing plate. For example, in FIG. 4, sections a and b arrive consecutively in the same web path. A two part cutting cylinder 20 first cuts the leading edge of section b with a blade 21 and then the trailing edge of section b (which is also the leading edge of section a) with a blade 22. The blades 21 and 22 are offset from their diametrically opposite locations by an offset angle θ, which may also be referred to as a phase angle. In a processing rotation of the cutting cylinder 20, the blade distance 21–22 is shorter than the blade distance 22–21. The difference in the developed lengths is twice the offset ½θd, where d is the diameter of the cutting cylinder 20 and θ is the angle in radians, or it is given as $2\theta d\pi/360°$ where θ is the angle in degrees. Typically, the difference between the cutting lengths for section a and section b will be chosen to be approximately 10 to 25 mm, because the downline inserters require such an offset for secure and dependable insertion processing.

After the section b signature has been cut from the web ribbon, it is retained by the respective pin tuck and it travels a complete rotation with the pin cylinder 15. As the leading edge of the section b signature arrives at the cutting nip between the cutting cylinder 20 and the pin cylinder 15, the cutting blade 22 cuts the leading edge of the section a signature. Section a is then placed directly onto the section b signature, until the blade 22 cuts the trailing edge of the section a signature. At that point, the section a signature lies on the section b signature. Upon a further half rotation in the clock-wise direction, the corresponding stack of b and a sections reaches the transfer point to the jaw cylinder. The tucking blade T at this time tucks the section a and b signatures for folding at the jaw cylinder, whereupon the half-folded double section (a+b) is transferred to the delivery fan 12.

What is claimed is:

1. A method of folding multi-section print material, which comprises:

transporting a plurality of sections of print material in a folder of a printing machine;

stacking the sections to form a stack of signatures having at least one of the signatures offset in the transport direction by a given amount; and subsequently folding the stack of signatures to form a half fold with the at least one offset signature protruding from the half fold by the given amount.

2. The method according to claim 1, which comprises:

simultaneously transporting the plurality of sections of print material along a first web path and a second web path;

cutting the sections of print material in the first and second web paths into respective signatures;

simultaneously delivering the signatures from the first web path and the second web path to a folding device, with the signatures from the first web path delayed by the given amount so as to form a stack of signatures having the signatures from the first web path offset by the given amount; and folding the stack of signatures in the folding device to form the half fold having a trailing edge of the signatures from the first web path projecting from the stack by the given amount.

3. The method according to claim 2, which comprises transporting the print material in a plurality of ribbons, subjecting each of the plurality of ribbons of the print material to a former fold, and selectively introducing the first-folded ribbons to the first web path or to the second web path.

4. The method according to claim 1, which comprises adjusting the given amount to substantially 10 to 25 mm.

5. The method according to claim 1, which comprises operating the folder in collect mode and thereby stacking the sections on a first cylinder of the folder.

6. The method according to claim 5, which comprises stacking the sections on a gripper cylinder of a gripper folder.

7. The method according to claim 5, which comprises stacking the sections on a pin cylinder of a pinned folder.

* * * * *